United States Patent [19]

Johnson et al.

[11] 4,117,312

[45] Sep. 26, 1978

[54] SELF-LIMITING TEMPERATURE ELECTRICAL HEATING CABLE

[75] Inventors: Ben C. Johnson, San Marcos; J. Scott Thornton, Austin; Donald E. Glowe, Austin; Patrick E. Cassidy, Austin; Robert E. Anderson, San Marcos, all of Tex.

[73] Assignee: Thermon Manufacturing Company, San Marcos, Tex.

[21] Appl. No.: 707,648

[22] Filed: Jul. 22, 1976

[51] Int. Cl.[2] ..... H05B 3/56

[52] U.S. Cl. ..... 219/548; 219/505; 219/528; 219/553; 338/22 R; 172/52

[58] Field of Search ..... 219/353, 386, 441, 494, 219/505, 528, 535, 541, 543, 544, 548, 552; 172/52 PE; 338/22 R, 22 SD, 23, 25, 214

[56] References Cited

U.S. PATENT DOCUMENTS

| | | | |
|---|---|---|---|
| 2,765,391 | 10/1956 | Shroyer | 219/455 |
| 2,804,532 | 8/1957 | Lacy-Hulbert | 219/552 X |
| 3,341,690 | 9/1967 | Commins | 219/528 |
| 3,375,774 | 4/1968 | Fujimura et al. | 219/441 X |
| 3,551,644 | 12/1970 | Sano et al. | 219/441 |
| 3,719,907 | 10/1955 | Combs | 219/528 |
| 3,748,439 | 7/1973 | Ting et al. | 219/353 |
| 3,757,086 | 9/1973 | Indoe | 219/528 |
| 3,878,501 | 4/1975 | Moorhead et al. | 338/22 R |
| 3,959,622 | 5/1976 | Bohdanov et al. | 219/528 |
| 3,995,141 | 11/1976 | Vieau et al. | 219/386 |
| 4,017,715 | 4/1977 | Whitney | 338/22 R |

*Primary Examiner*—J. V. Truhe
*Assistant Examiner*—M. Paschall
*Attorney, Agent, or Firm*—Pravel, Wilson & Gambrell

[57] ABSTRACT

An electrical heating cable which limits power output once an established temperature limit is reached. The cable includes a high-resistance element and a temperature-sensitive variable resistance element electrically connected in series between two electrical conductors otherwise insulated from each other by insulating material. The temperature-sensitive resistance undergoes a substantial positive increase in resistivity when the temperature of the cable nears the established temperature limit. The increase in resistivity substantially reduces the heat-generating current flowing in the cable to limit the power output.

14 Claims, 8 Drawing Figures

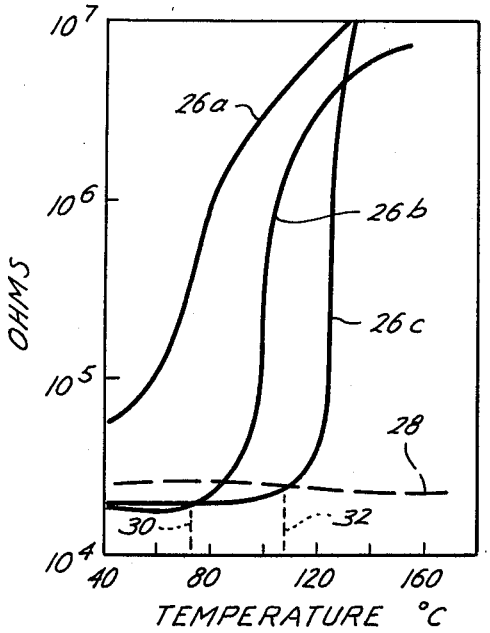
Fig. 1
Fig. 3A
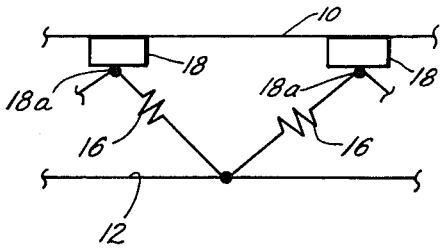
Fig. 2
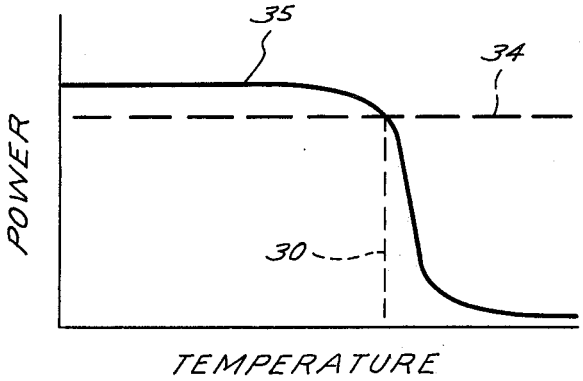
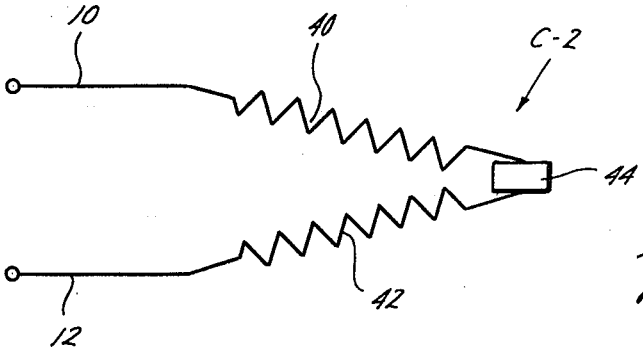
Fig. 5

SELF-LIMITING TEMPERATURE ELECTRICAL HEATING CABLE

BACKGROUND OF THE INVENTION

1. Field of the Invention

The present invention relates to electrical heating cables.

2. Description of the Prior Art

Electrical heating cables and tapes, as exemplified by U.S. Pat. Nos. 2,719,902 and 3,757,086, have been used commercially for some time to provide heat to pipes and tanks in cold environments.

In the past, control of the temperature of these cables has been achieved by means of an external thermostat which interrupts the current flow to the cable at a specified temperature limit. These external thermostats, even when carefully installed, could be so located that the pipe or tank temperature was sensed and controlled without regard for the actual temperature of the heating cable. In addition, these thermostats were prone to failure, resulting in thermal run-away when the thermostat failed, degradation of the electrical insulation, and possible destruction of the heating cable.

SUMMARY OF THE INVENTION

Briefly, the present invention provides a new and improved electrical heating cable which has a temperature self-limiting capability. The electrical heating cable includes first and second electrical conductors situated in proximity with each other and insulated from each other by insulation material. The conductors receive operating current from a power supply. A resistance is electrically connected between the electrical conductors so that current flows through the resistance when power is applied across the electrical conductors. The resistance includes a high-resistance, heat producing, material which produces heat for heating purposes when current flows therethrough, as well as a temperature-sensitive variable resistance material.

The temperature sensitive material has a temperature limit substantially equal to the desired self-limiting temperature of the heating cable and undergoes a substantial increase in temperature coefficient of resistance when this limit is reached, so that the resistance substantially increases. The current flowing substantially decreases in response to the increased resistance, limiting power output from the cable to thereby prevent overheating of the heating cable.

BRIEF DESCRIPTION OF THE DRAWINGS

FIG. 1 is a graphical presentation of resistance-temperature characteristics of materials used in the electrical heating cable of the present invention;

FIG. 2 is a graphical illustration of the power-temperature characteristics of electrical heating cables;

FIG. 3A is a schematic electrical circuit diagram of the electrical heating cable of FIG. 3;

FIG. 5 is a schematic electrical diagram illustrating another embodiment of the electrical heating cable of the present invention;

DESCRIPTION OF THE PREFERRED EMBODIMENT

Figure 3:
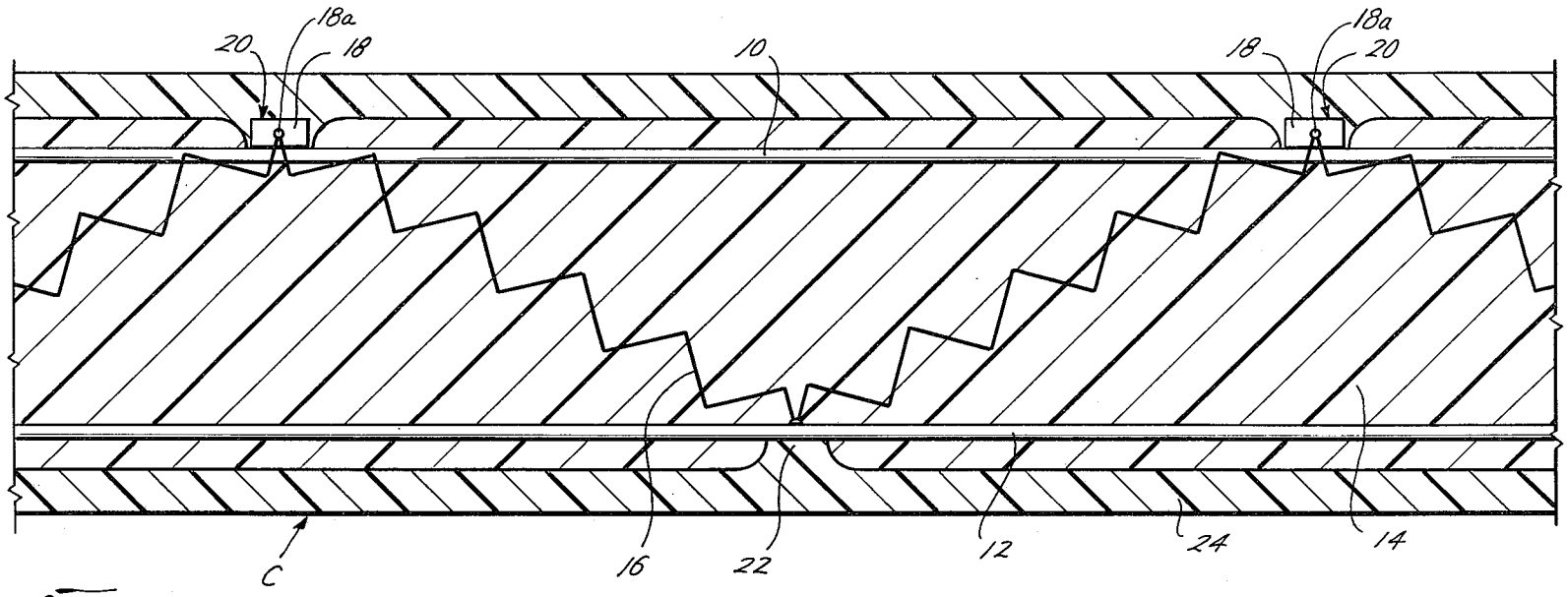
FIG. 3 is a cross-sectional view of an electrical heating cable of the present invention.

In the drawings, the letter C designates generally a temperature self-limiting electrical heating cable or tape of the present invention which may be used to provide heat to pipes, tanks and the like in cold environments and elsewhere. The cable C provides heat as a result of the power consumed when electric current flows therethrough, and is placed in proximity to the object to be heated.

The electrical heating cable C includes two elongate electrical conductors 10 and 12 (FIG. 3) situated in proximity with each other and insulated from each other by a suitable primary insulating material 14. A high-resistance material 16 capable of producing heat when current flows therethrough and a temperature-sensitive variable resistance material 18 are electrically connected in series between the two electrical conductors in a manner to be set forth.

Electric power is applied to the conductors 10 and 12 from a suitable power supply to cause current to flow through the high-resistance material 16 and the temperature-sensitive variable resistance material 18 connected between conductors 10 and 12. The electrical conductors 10 and 12 are of copper or other suitable conductive metal, which are insulated from each other by the primary insulation material 14 which completely surrounds such conductors except at intervals formed for connection of the materials 16 and 18 to such conductor. The primary insulation 14 is a suitable rubber or thermoplastic insulating material, and is removed at specified intervals to form alternating slits along the length of the cable C, as exemplified at 20 and 22, where the electrical conductors 10 and 12 are exposed.

The high-resistance material 16 in the first embodiment is a heating wire, such as a nichrome wire. The wire 16 is spirally wound around the electrical conductors 10 and 12 so that electrical contact is made, as schematically indicated (FIG. 3), with the conductors 10 and 12 in the slits 20 and 22. The length of heating wire 16 between alternate slits 20 and 22 may vary depending upon the amount of heat to be generated and the type of application for which the electrical heating cable is to be used. In this manner, the heating wire 16 functions as a plurality of discrete resistance elements electrically connected in parallel between conductors 10 and 12.

The temperature-sensitive variable resistance material 18 includes a plurality of discrete elements or chips which are mounted in selected ones of the slits 20 and 22 in electrical contact with the heating wire 16 at contacts **18*a* and electrical conductors 10 and 12** of the cable C.

The chips 18 of variable resistance material are electroded with ohmic contacts before attachment to the conductors 10 and 12 to provide direct electrical contact therewith. The ohmic contacts on the chips 18 are formed by conventional processes, such as vapor deposition, flame-spraying and the like. The chips 18 are also connected to the heating wire 16 in a like manner.

If desired, an electrically conductive thermosetting plastic material, such as carbon-filled epoxy or conductive solder, may be applied over the heating wires 16 and the chip 18 as well as between the chip 18 and the conductors 10 and 12.

An outer enclosing insulation jacket or sleeve 24 is then placed around the conductors 10 and 12, insulation 14, wire 16 and chips 18 to provide external insulation for the cable C.

The temperature-sensitive variable resistance of the chips 18 may be any material characterized by a large positive increase in temperature coefficient of resistivity or anomaly in the vicinity of its ferroelectric-paraelectric transition temperature, which is commonly referred to as the Curie point. The Curie point of the material to be used is chosen to be approximately equal to the desired self-limiting temperature of the electrical heating cable C. In this type material, the electrical resistance prior to reaching the Curie point is typically small in comparison to the resistance of the material in the vicinity of the Curie point. For example, a group of curves 26*a*, 26*b* and 26*c* of FIG. 1 indicate resistivity per unit area as a function of temperature for materials used as the temperature sensitive material 18 of the present invention. A curve 28 indicates the resistivity-temperature performance of material suitable for heating wire 16. Lines 30 and 32 indicate Curie points for the materials illustrated in curves 26*b* and 26*c*, respectively.

As is evident, the variable resistance materials 18 have a resistance in the same order of magnitude as the high-resistance material 16 within the temperature range below the Curie points of the materials. The resistance of the variable resistance materials 18, however, rapidly increases by several orders of magnitude within a relatively small increase in temperature (5°–10° C.) in the vicinity of the Curie points.

One suitable temperature-sensitive variable resistance materials for use in the present invention are those materials used in semiconductor elements known as thermistors. An N-type semiconductor material is formed by doping barium titanate or a related perovskite material with lanthanum ions or other element ions of higher valence than barium or titanium, as described in more detail in United States Pat. Nos. 3,416,957 and 3,351,568.

By doping barium titanate with lanthanum ions, the room temperature resistance value of the resulting semiconductor material is lowered from the very high resistance value typical of barium titanate material to a resistance in the same order of magnitude as the heat-generating high-resistance material 16, thereby also shifting the Curie point to a temperature approximately equal to the desired self-limiting temperature of the electrical heating cable. By varying the amount and valence of the impurity ions in the barium titanate material, the Curie point, and hence the desired self-limiting temperature, may be varied. The overall resistance of the doped semiconductor material 18 depends on the physical dimensions of the material as well as the concentration of impurity ions. For example, a 7mm × 3mm × 1.5mm chip of barium titanium material doped with a given concentration of lanthanum ions was found to have a resistance of 300 ohms at 25° C., a Curie point of 75° C., and a resistance of 30,000 ohms at 80° C.

In the past, electrical heating cables having current flowing only through a heat-generating high-resistance material H continued to consume substantially the same amount of power for a given voltage over the entire temperature range as shown by the line 34 in FIG. 2, past the desired self-limiting temperature necessary to prevent cable damage due to overheating. By inserting the temperature-sensitive variable resistance 18 in series with the high-temperature resistance material 16 according to the present invention, however, the power converted into heat by the high-resistance material, indicated by the line 35 in FIG. 2, is reduced substantially when the temperature of the variable resistance approaches the Curie point 30 of the resistance 18. In this temperature range, the resistivity of the variable resistance 18 substantially increases the overall resistance in the cable C, thereby substantially reducing the current flowing therethrough and reducing heat.

It has been found that the chips 18 of barium titanate having a Curie temperature of 75° C. and the dimensions and characteristics previously described, when placed in series with the high-resistance wire 16 in the manner described above, substantially reduce the current flow and power consumed by the electrical heating cable C as the temperature increases from the Curie point. Reduction of the current flow further causes the temperature of the cable C to stabilize at a temperature below the Curie point.

Figure 4:
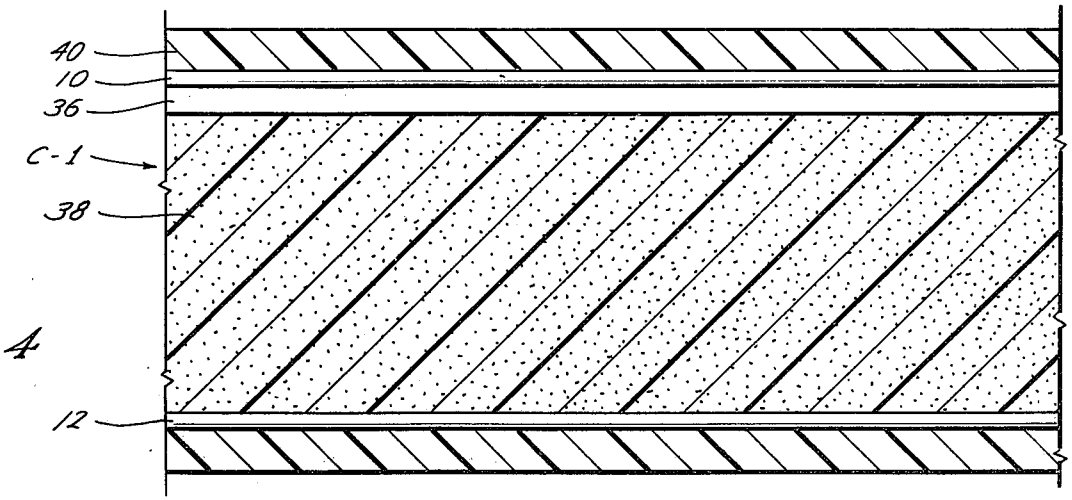
FIG. 4 is a cross-sectional view of an alternate embodiment of the electrical heating cable of the present invention.

In an alternate embodiment C-1 of the self-limiting electrical heating cable (FIG. 4), one of the electrical conductors 10 and 12, or both if desired, are coated with a layer 36 of temperature-sensitive variable resistance material so as to form an electrical contact therewith in the manner previously described. Next, a layer 38 of heating or high-resistance material is disposed between the electrical conductors 10 and 12 along their length, electrically connecting the heating material in series with the layer 32 of variable resistance material between the conductors 10 and 12. The conductors 10 and 12, as well as the temperature-sensitive variable resistance material 36 and heating material 38 are enclosed in a suitable insulating material 40.

A suitable high-resistance material 38 for the cable C-1 is formed by depositing graphite particles in a thermoplastic material, forming an electrically conductive material sufficiently flexible to be used in electrical heating cables which may be wrapped in a variety of configurations according to the size of the article to be heated.

In a third embodiment (FIG. 5), the electrical heating cable C-2 includes high-resistance wires 40 and 42 which have one end thereof electrically connected with electrical conductors 10 and 12, respectively. The opposite ends of the wires 40 and 42, in turn, are electrically connected to opposite sides of a temperature-sensitive variable resistance element 44, such as a chip of barium titanate doped with lanthanum ions as set forth above, so that the element 44 is connected in series with the wires 40 and 42.

When an electric voltage is applied across the conductors 10 and 12 from a suitable voltage source, current flows through the high-resistance material, generating heat. As the temperature of the element 44 reaches its Curie point, the resistance between the conductors 10 and 12 is substantially increased and the current flowing therethrough substantially decreases, thereby preventing the temperature of the electrical heating cable A from going above the desired self-limiting temperature.

Figure 7:
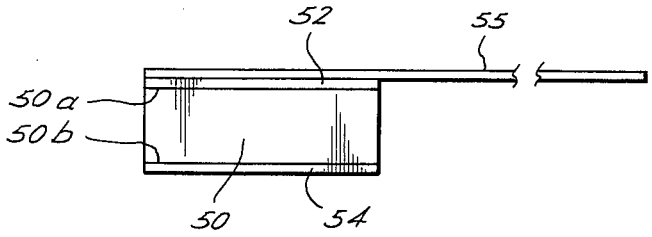
FIG. 7 is an enlarged elevation view of a chip of temperature sensitive material used in the cable of FIG. 6.
Figure 6:
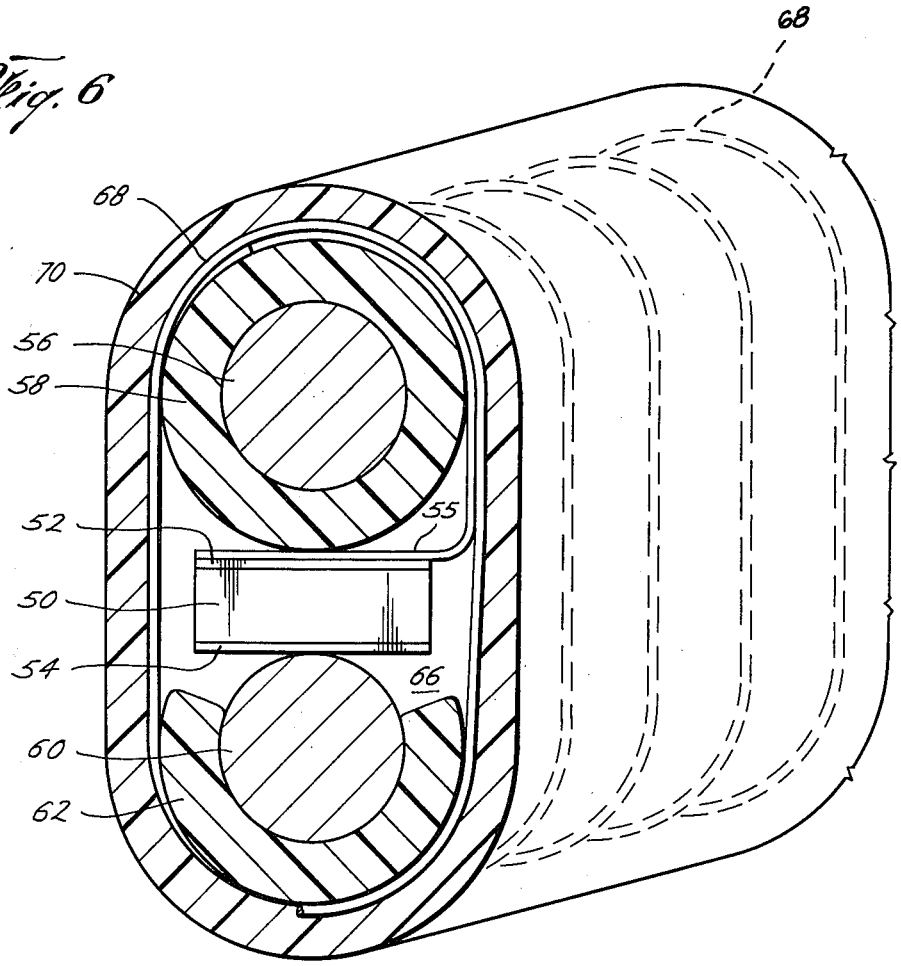
FIG. 6 is a cross-sectional view of another embodiment of an electrical heating cable of the present invention.

Another cable C-3 (FIGS. 6 and 7) of the present invention has a chip 50 of temperature sensitive material, of the type set forth above, mounted therein in an alternate manner from the cable C. The chip 50 (FIG. 7) is first electroded with opposite side faces 50*a* and 50*b* with an outer electrode coating 52 and 54, respectively, of copper or other conductive material.

A thin strip of conductive material 55, such as copper, is then positioned against one of the electrode coatings, 52 for example, and soldered thereto.

A first elongated electrical conductor 56 covered by an insulating jacket 58 and a second elongated electrical conductor 60 covered by an insulating jacket 62 receive operating power from a suitable source and convey electrical current through the length of the cable C-3 for conversion into heat therein.

At each desired location along the length of the cable C-3 where a temperature sensitive chip 50 is to be alternately electrically connected to the conductors 56 and 60, a section of insulation of approximately the size of the chip 50 is removed, forming an opening or hole indicated at 66, from an inner surface of one of the conductors 56 and 60.

The chip 50 with attached foil strip 55 is then mounted in the opening 66 with the foil strip 55 opposite the exposed conductor 60, with the mechanical contact between the exposed wire 60 and surface 54 forming an electrical contact therebetween. The strip 55 is then bent around the insulative covering 58 of the other conductor 56.

A high-resistance heating wire 68, of a similar material to the wire in the cable C, is then spirally wound about the conductors 56 and 60 along their length, bringing the wire 68 into contact with each of the exposed foil strips 55 to insure that contact is made therebetween.

It is to be noted that the wound wire 68 is not in physical or electrical connection contact with the exposed portions of the other conductor 60 at such location. An outer insulating jacket 70 is then applied to enclose and cover the heating wire 68, chips 50, and conductors 56 and 60.

The cable C-3 provides several advantages, including that the chip 50 may be brought into pressure contact with both the conductors 56 and 60 and heating wire 68 without need for solder or adhesives. Also, the wire 68 may be continuously wrapped on the conductors 56 and 60, making contact through foil strip 55 to one surface of the chip 50 without shorting to the other conductor or inner surface of the chip 50.

The foregoing disclosure and description of the invention are illustrative and explanatory thereof and various changes in the size, shape and materials, as well as in the details of the illustrated construction may be made without departing from the spirit of the invention.

We claim:

1. A temperature self-limiting electrical heating cable or tape to provide heat to pipes, tanks and the like, comprising:

(a) first conductor means and second conductor means for conveying electrical current extending in proximity to each other along the length of the cable;

(b) insulating means, comprising:

(1) insulating material mounted to enclose said first and second conductor means along the length of the cable and to insulate said first and second conductor means from each other; and (2) said insulating material having portions thereof removed at intervals along the length of the cable to form slits and permit electrical contact with said first and second conductor means;

(c) a plurality of heating elements electrically connected between said first and second conductor means for producing heat when current flows therethrough; and (d) variable resistance means comprising a plurality of chips of variable resistance heating material mounted in selected ones of said slits in said insulating material, each of said chips being electrically connected in series with selected ones of said plurality of heating elements between said first and second conductor means, said chips of variable resistance heating material substantially increasing in resistance when a temperature limit is reached to reduce the current flowing through said heating elements and control the heat output of the cable.

2. The electrical heating cable of claim 1, wherein said plurality of heating elements comprises:

a plurality of resistance heating elements electrically connected in parallel between said first and second conductor means along the length of the cable.

3. The electrical heating cable of claim 2, wherein said plurality of heating elements comprises:

an electrical heating wire wound about and alternately electrically connected to said first conductor means and said second conductor means.

4. The electrical heating cable of claim 3, wherein said variable resistance means comprises:

a plurality of chips of variable resistance material spaced apart from each other along said first electrical conductor, each of said chips having a first portion thereof in electrical contact with said first electrical conductor.

5. The electrical heating cable of claim 4, wherein each of said plurality of chips comprises:

doped barium titanate.

6. The electrical heating cable of claim 4, wherein each of said plurality of chips comprises:

barium titanate doped with ions to obtain a Curie point substantially equal to the desired self-limiting temperature of the cable.

7. The electrical heating cable of claim 3, further including:

jacket means for enclosing said heating wire, said variable resistance means and said first and second conductor means.

8. The electrical heating cable of claim 7, wherein said plural variable resistance elements are mounted in ohmic contact with at least one of said first and second conductor means.

9. The electrical heating cable of claim 7, wherein said plural variable resistance elements are mounted in electrode contact with at least one of said first and second conductor means.

10. The electrical heating cable of claim 2, wherein said heating means comprises:

a layer of high-resistance heating material mounted between said first and second conductor means.

11. The electrical heating cable of claim 10, wherein said variable resistance means comprises:

a variable resistance material mounted between said layer of high-resistance heating material and at least one of said conductor means.

12. The electrical heating cable of claim 11, wherein said variable resistance material comprises:

barium titanate.

13. The electrical heating cable of claim 11, wherein said variable resistance material comprises:

barium titanate doped with ions to obtain a Curie point substantially equal to the desired self-limiting temperature of the cable.

14. The electrical heating cable of claim 10, wherein said layer of high-resistance heating material comprises:

a thermoplastic material having graphite particles deposited therein.

* * * * *